US007981582B2

(12) United States Patent
Veregin et al.

(10) Patent No.: US 7,981,582 B2
(45) Date of Patent: Jul. 19, 2011

(54) TONER AND DEVELOPER COMPOSITIONS WITH A SPECIFIC RESISTIVITY

(75) Inventors: Richard P. N. Veregin, Mississauga (CA); Michael S. Hawkins, Cambridge (CA); Vladislav Skorokhod, Mississauga (CA); Valerie M. Farrugia, Oakville (CA)

(73) Assignee: Xerox Corporation, Norwalk, CT (US)

( * ) Notice: Subject to any disclaimer, the term of this patent is extended or adjusted under 35 U.S.C. 154(b) by 1482 days.

(21) Appl. No.: 11/159,177

(22) Filed: Jun. 23, 2005

(65) Prior Publication Data

US 2006/0292475 A1 Dec. 28, 2006

(51) Int. Cl.
*G03G 9/08* (2006.01)

(52) U.S. Cl. ..... 430/109.4; 430/111.41; 430/111.35; 430/111.32; 430/109.3

(58) Field of Classification Search ..... 430/109.4, 430/111.35, 111.32, 111.41, 109.3
See application file for complete search history.

(56) References Cited

U.S. PATENT DOCUMENTS

| | | | | |
|---|---|---|---|---|
| 3,590,000 | A | | 6/1971 | Palermiti et al. |
| 3,847,604 | A | | 11/1974 | Hagenbach et al. |
| 4,546,060 | A | | 10/1985 | Miskinis et al. |
| 4,558,108 | A | | 12/1985 | Alexandru et al. |
| 4,810,611 | A | | 3/1989 | Ziolo et al. |
| 4,935,326 | A | | 6/1990 | Creatura et al. |
| 5,227,460 | A | | 7/1993 | Mahabadi et al. |
| 5,290,654 | A | | 3/1994 | Sacripante et al. |
| 5,308,734 | A | | 5/1994 | Sacripante et al. |
| 5,370,963 | A | | 12/1994 | Patel et al. |
| 5,510,220 | A | | 4/1996 | Nash et al. |
| 5,593,807 | A | | 1/1997 | Sacripante et al. |
| 5,876,893 | A | | 3/1999 | Ochiai et al. |
| 5,900,343 | A | * | 5/1999 | Ochiai et al. ..... 430/111.33 |
| 5,994,019 | A | * | 11/1999 | Okado et al. ..... 430/111.33 |
| 6,177,219 | B1 | | 1/2001 | Yuh et al. |
| 6,319,647 | B1 | | 11/2001 | Gutman et al. |
| 6,355,391 | B1 | | 3/2002 | Van Dusen et al. |
| 6,365,316 | B1 | | 4/2002 | Stamp et al. |
| 6,416,916 | B1 | | 7/2002 | Silence et al. |
| 6,423,460 | B1 | | 7/2002 | Drappel et al. |
| 6,764,799 | B2 | | 7/2004 | Skorokhod et al. |
| 2003/0235773 | A1 | | 12/2003 | Skorokhod et al. |
| 2004/0137350 | A1 | * | 7/2004 | Yamazaki et al. ..... 430/108.7 |
| 2004/0137352 | A1 | | 7/2004 | McStravick |
| 2004/0142266 | A1 | | 7/2004 | Sacripante |
| 2005/0031979 | A1 | | 2/2005 | McStravick |

FOREIGN PATENT DOCUMENTS

| | | | |
|---|---|---|---|
| EP | 1 439 430 | A | 7/2004 |
| EP | 1 441 260 | A | 7/2004 |
| JP | 2001-305796 | | 11/2001 |
| JP | 2004-157473 | | 6/2004 |
| JP | 2004-191927 | | 7/2004 |
| JP | 2004-287196 | | 10/2004 |

OTHER PUBLICATIONS

Diamond, Arthur S & David Weiss (eds.) Handbook of Imaging Materials, 2nd ed.. New York: Marcel-Dekker, Inc. (Nov. 2001) pp. 209, 210, 217-222.*
Submission of Document together with English-language Translation mailed Jan. 15, 2010.

* cited by examiner

*Primary Examiner* — Christopher RoDee
(74) *Attorney, Agent, or Firm* — Oliff & Berridge, PLC

(57) ABSTRACT

A toner having a crystalline or semi-crystalline polyester resin, an amorphous resin and a colorant. The toner preferably exhibits a resistivity of at least $1\times10^{11}$ ohm-cm. A developer may be produced including the toner and optionally a carrier. If a carrier is included, the carrier preferably exhibits a resistivity of greater than $1\times10^{7}$ ohm-cm. An electrophotographic machine includes the toner exhibiting high resistivity.

10 Claims, No Drawings

TONER AND DEVELOPER COMPOSITIONS WITH A SPECIFIC RESISTIVITY

BACKGROUND

Described herein are developer compositions. More specifically, described herein are developers comprising a high resistivity toner and optionally a high resistivity carrier.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to control developer adhesion. The rotation of the sleeve transports magnetically adhered developer through the development zone where there is direct contact between the developer brush and the imaged surface, and charged toner particles are stripped from the passing magnetic brush filaments by the electrostatic fields of the image.

Magnetic brush development is generally described with respect to the resistivity properties of the carrier being utilized in the magnetic brush. An insulative magnetic brush utilizes a carrier with a resistivity of about $10^{13}$ to $10^{18}$ ohm-cm. A conductive magnetic brush utilizes a carrier with a resistivity of about $10^{-5}$ to $10^{7}$ ohm-cm. And, a semiconductive magnetic brush utilizes a carrier with an intermediate resistivity of about $10^{7}$ to $10^{13}$ ohm-cm, U.S. Pat. No. 4,546,060, which is incorporated herein by reference, discloses an electrographic, two-component dry developer composition comprising charged toner particles and oppositely charged, magnetic carrier particles. The developer is employed in combination with a magnetic applicator comprising a rotatable magnetic core and an outer, non-magnetizable shell to develop electrostatic images.

Toners having crystalline polyester resins or semi-crystalline resins that are employed in various image development systems are known. Specifically, crystalline toners such as those taught in U.S. Patent Publication No. 2004-0142266 are known and incorporated herein by reference.

One issue with current crystalline and semi-crystalline toners and development systems comprising such toners is that they do not perform well in all humidities. It is desirable that developers be functional under all environmental conditions to enable good image quality from a printer. In other words, it is desirable for developers to function at low humidity such as a 15% relative humidity (denoted herein as C-zone) and at high humidity such as at 85% relative humidity (denoted herein as A-zone).

Toner blends containing crystalline or semi-crystalline polyester resins with an amorphous resin have been recently shown to provide very desirable ultra-low melt fusing, which is a key enabler for high-speed printing and for lower fuser power consumption. These types of toners containing crystalline polyester have been demonstrated in both emulsion aggregation (EA) toners, and in conventional jetted toners. One of the most serious issues with all toners containing crystalline or semi-crystalline polyester resins, has been the low charge in A-zone.

EA branched polyester toners containing crystalline polyesters show demonstrated ultra-low melt fusing performance, with very low minimum fixing temperature (MFT) and high gloss. However, charging performance, particularly in A-zone, has been a significant issue.

Thus, developers comprising crystalline toners that exhibit good charging in both A-zone and C-zone are still desired.

SUMMARY

In a first embodiment, toner is described having a crystalline or semi-crystalline polyester resin, an amorphous resin and a colorant, wherein the toner has a resistivity of at least about $1\times10^{11}$ ohm-cm.

Also described is a developer including the toner particles. In another embodiment, the developer additionally comprises a carrier having a resistivity of at least about $1\times10^{7}$ ohm-cm.

An electrophotographic image forming apparatus is also described comprising a photoreceptor, a semiconductive magnetic brush development system, and a housing in association with the semiconductive magnetic brush development system for a developer comprising a toner comprising a crystalline polyester resin, an amorphous resin and a colorant, wherein the toner has a resistivity of at least about $1\times10^{11}$ ohm-cm. In embodiments, the developer may additionally comprise a carrier having a resistivity of at least about $1\times10^{7}$ ohm-cm.

DETAILED DESCRIPTION OF EMBODIMENTS

In embodiments, the developers are preferably selected for imaging and printing systems with semi-conductive magnetic brush development. Preferably, the toners in the developers are comprised of crystalline or semi-crystalline polyester resin.

As used herein, "crystalline" refers to a polymer with a three dimensional order. "Semicrystalline resins" as used herein refer to resins with a crystalline percentage of, for example, from about 10 to about 60%, and more specifically from about 12 to about 50. Further, as used hereinafter "crystalline polyester resins" and "crystalline resins" encompass both crystalline resins and semicrystalline resins, unless otherwise specified.

In further embodiments, the crystalline polyester resin(s) are used together with an amorphous resin, for example an amorphous polyester resin or an amorphous polystyrene or polystyrene acrylate resin.

Emulsion aggregation (EA) toners having crystalline polyester and amorphous resin show improved C-zone charge with increased toner resistivity. This is observed for carriers with low or high resistivity With developers including low resistivity carriers, charge performance in the A-zone is very low, while charge performance in the C-zone is acceptable. Charge performance only slightly improves in the A-zone when the developer further includes a high resistivity toner.

However, when the developer includes both a high resistivity carrier and a high resistivity toner, charge performance in the A-zone is improved. It has been demonstrated that acceptable charge performance in the A-zone and C-zone can be obtained with the combination of high resistivity toner and high resistivity carrier. Thus, in embodiments, developers with crystalline polyester containing high resistivity toners in combination with high resistivity carrier provides improved A-zone and C-zone charge performance.

Thus, a single component developer, i.e., a developer containing only toner and no carrier, having a toner with high resistivity demonstrates improved charging in the C-zone. Further, a two component developer having a toner with high resistivity and a carrier with high resistivity demonstrates improved charging in both the A-zone and the C-zone.

The developer compositions disclosed herein can be selected for electrophotographic, especially xerographic, imaging and printing processes, including digital processes. The toners may be used in image development systems employing any type of development scheme without limitation, including, for example, conductive magnetic brush development (CMB), which uses a conductive carrier, insulative magnetic brush development (IMB), which uses an insulated carrier, semiconductive magnetic brush development (SCMB), which uses a semiconductive carrier, etc. Most preferably the developers are used in SCMB development systems.

The present disclosure is equally applicable to all semiconductive magnetic brush toner/developers, to conventional toners, and to emulsion/aggregation toners, as well as other chemically prepared toners, for example suspension or encapsulated toners. Suitable and preferred material for use in preparing toners herein will now be discussed.

Preferably, the toner is an EA toner containing crystalline polyester resin and an amorphous resin. The amorphous resin may be linear or branched. Further, in embodiments, the crystalline polyester resin and amorphous resin, regardless if linear or branched, may be sulfonated. Although, in embodiments the toner is described as comprising a crystalline polyester resin and an amorphous resin, one of ordinary skill in the art will understand that any toner with the desired resistivity may be utilized herein.

Preferably, the crystalline polyester resin contains a sulfonation of less than about 3.0 mole % and the amorphous sulfonated polyester resin contains a sulfonation percentage greater than the sulfonation of the crystalline sulfonated polyester resin, more preferably the amorphous polyester resin contains a sulfonation between about 0.25 mole % and about 5.0 mole %.

The weight ratio of the crystalline polyester resin to the amorphous resin present in the mixture is preferably from about 10:90 to about 50:50, more preferably from about 10:90 to about 30:70.

Examples of crystalline polyester resins suitable for use herein include, for example, alkali sulfonated polyester resins. Specific crystalline resin examples include, but are not limited to, alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly (5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly (octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly (ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), and wherein the alkali is a metal such as sodium, lithium or potassium.

If semicrystalline polyester resins are employed herein, the semicrystalline resin includes, but is not limited to poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly (octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), and poly(p-xylylene pimelamide). The semicrystalline resins possess, for example, a suitable weight average molecular weight Mw, such as from about 7,000 to about 200,000, and more specifically from about 10,000 to about 150,000, a number average molecular weight Mn of, for example, from about 1,000 to about 60,000, and more specifically, from about 3,000 to about 50,000.

The crystalline resin can possess various melting points of, for example, from about 30° C. to about 120° C., and preferably from about 50° C. to about 90° C., and, for example, a number average molecular weight (Mn), as measured by gel permeation chromatography (GPC) of, for example, from about 1,000 to about 50,000, and preferably from about 2,000 to about 25,000; with a weight average molecular weight (Mw) of the resin of, for example, from about 2,000 to about 100,000, and preferably from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resins may be prepared by the polycondensation process of reacting an organic diol, and an organic diacid in the presence of a polycondensation catalyst, although making the crystalline polyester resin is not limited to such process. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfo-aliphatic diacid can be selected in an amount of from about 1 to about 10 mole percent of the resin.

The linear and branched amorphous sulfonated resins, in embodiments, possess, for example, a number average molecular weight (Mn), as measured by GPC, of from about 10,000 to about 500,000, and preferably from about 5,000 to about 250,000; a weight average molecular weight (Mw) of, for example, from about 20,000 to about 600,000, and preferably from about 7,000 to about 300,000, as determined by GPC using polystyrene standards; and a molecular weight distribution (Mw/Mn) of, for example, from about 1.5 to about 6, and more specifically, from about 2 to about 4.

The linear amorphous resins are generally prepared by the polycondensation of an organic diol and a diacid or diester, at least one of which is preferably a sulfonated or a sulfonated difunctional monomer being included in the reaction, and a polycondensation catalyst. For the branched amorphous sulfonated resin, the same materials may be used, with the further inclusion of a branching agent such as a multivalent polyacid or polyol.

Examples of diacid or diesters selected for the preparation of amorphous include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin. Examples of diols utilized in generating the amorphous resin include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and mixtures thereof. The amount of organic diol selected can vary, and more specifically, is, for example, from about 45 to about 52 mole percent of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 weight percent of the resin can be selected.

Branching agents for use in forming the branched amorphous sulfonated resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Polycondensation catalyst examples for either the crystalline or amorphous resins include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Other examples of amorphous resins that are not amorphous polyester resins that may be utilized herein include, but are not limited to poly(styrene-butadiene), poly(methylstyrene-butadiene), poly(methyl methacrylate-butadiene), poly (ethyl methacrylate-butadiene), poly(propyl methacrylate-butadiene), poly(butyl methacrylate-butadiene), poly(methyl acrylate-butadiene), poly(ethyl acrylate-butadiene), poly (propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-β-carboxyethyl acrylate), poly (styrene-butadiene-acrylonitrile-β-carboxyethyl acrylate), poly(styrene-butyl acrylate-β-carboxyethyl acrylate), and poly(styrene-butyl acrylate-acrylononitrile-β-carboxyethyl acrylate). Such an amorphous resin possesses a weight average molecular weight Mw of, for example, from about 20,000 to about 55,000, and more specifically, from about 25,000 to about 45,000, a number average molecular weight Mn of, for example, from about 5,000 to about 18,000, and more specifically, from about 6,000 to about 15,000.

Various known colorants, such as pigments, present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans that may be selected include copper tetra (octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity for the purpose of color gamut are NEOPEN Yellow 075, NEOPEN Yellow 159, NEOPEN Orange 252, NEOPEN Red 336, NEOPEN Red 335, NEOPEN Red 366, NEOPEN Blue 808, NEOPEN Black X53, NEOPEN Black X55, wherein the dyes are selected in various suitable amounts, for example from about 0.5 to about 20 percent by weight, and more specifically, from about 5 to 20 weight percent of the toner. Colorants include pigment, dye, mixtures of pigment and dyes, mixtures of pigments, mixtures of dyes, and the like. This listing of colorants is for illustration only, any suitable colorant may be used herein. As understood by one of ordinary skill, pigments are predispersed in a surfactant or resin binder to facilitate mixing.

Toners having a crystalline polyester resin and an amorphous resin demonstrate ultra low melt fusing performance with a low minimum fixing temperature and high gloss. Dispersion for the EA process may be generated by a process generally known as the solvent flash evaporation process. Solvent flash evaporation process is disclosed in U.S. patent application Ser. No. 10/778,557, which is incorporated herein in its entirety by reference. The EA toner dispersions may be generated by other processes including, but not limited to, the melt mixing process disclosed in Ser. No. 11/094,413, which is incorporated herein in its entirety by reference.

The polyester toner particles may be created by the emulsion/aggregation (EA) process, which are illustrated in a number of patents, such as U.S. Pat. Nos. 5,593,807, 5,290,654, 5,308,734, and 5,370,963, each of which are incorporated herein by reference in their entirety. The polyester may comprise any of the polyester materials described in the aforementioned references.

In embodiments, the toner may be generated by well known processes other than by an EA process, i.e., physical processes in which a mixture of toner material is ground to toner particles include jetting, such as physical processes of making toner as illustrated in number of patents, such as U.S. Pat. Nos. 6,177,221, 6,319,647, 6,365,316, 6,416,916, 5,510,220, 5,227,460, 4,558,108, and 3,590,000, each of which are incorporated herein by reference in their entirety. The conventional jetted toners comprise materials described in the aforementioned references.

Any resin binder suitable for use in toner preparation may be employed without limitation. Further, toners prepared by chemical methods (emulsion/aggregation) and physical methods (grinding) may be equally employed. Specific suitable toner examples are as follows.

Although the toner may be any type of toner containing a crystalline polyester resin and an amorphous resin, it must have a resistivity of at least about $1\times10^{11}$ ohm-cm. The resistivity of the toner may be regulated by a variety factors including, but not limited to the amount of crystalline polyester resin in the toner, the amount of sulfonation, the amount of alkali metal present in the toner, and the choice of the alkali metal type. For example, increasing the crystalline polyester content from 20% to 50% will generally reduce the resistivity of the toner, as the crystalline polyester is generally less resistive than the amorphous resin. Another example of regulating resistivity is that changing the sulphonation level of the amorphous resins and/or the crystalline polyester changes the resistivity. In particular, changing the sulphonation level from 1.5% Li sulphonate to 3.0% Li sulphonate by a factor of 1000 affects resistivity as demonstrated herein. Yet another example of regulating resistivity of the toner is accomplished by changing the Li sulphonate to Na sulphonate. Generally, addition of a more insulative material to the toner bulk or toner surface can also increase the resistivity of the toner.

Illustrative examples of carrier particles that can be selected for mixing with the toner composition prepared in accordance with the present disclosure include those particles that are capable of triboelectrically obtaining a charge of opposite polarity to that of the toner particles. Illustrative examples of suitable carrier particles include granular zircon, granular silicon, glass, steel, nickel, ferrites, magnetites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 6,764,799, 6,355,391, 4,937,166 and 4,935,326, the disclosures of which are hereby totally incorporated herein by reference.

In a most preferred embodiment, the carrier core is comprised of a ferrite.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings and the like. In embodiments, the carrier coating may comprise polymethyl methacrylate, copoly-trifluoroethyl-methacrylate-methyl methacrylate, polyvinylidene fluoride, polyvinylfluoride copolybutylacrylate methacrylate, copoly perfluorooctylethylmethacrylate methylmethacrylate, polystyrene, or a copolymer of trifluoroethyl-methacrylate and methylmethacrylate containing a sodium dodecyl sulfate surfactant. The coating may include additional additives such as a conductive additive, for example carbon black.

In another embodiment, the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted.

The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

In another preferred embodiment herein, the polymer coating of the carrier core is comprised of PMMA, most preferably PMMA applied in dry powder form and having an average particle size of less than 1 micrometer, preferably less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers herein is provided by the temperature at which the carrier coating is applied, higher temperatures resulting in higher tribo up to a point beyond which increasing temperature acts to degrade the polymer coating and thus lower tribo.

Carrier cores with a diameter of, for example, about 5 micrometers to about 100 micrometers may be used. More specifically, the carrier cores are, for example, about 20 micrometers to about 60 micrometers. Most specifically, the carriers are, for example, about 30 micrometers to about 50 micrometers. In an especially preferred embodiment, a 35 micrometer ferrite core available from Powdertech of Japan is used. The preferred ferrite core is a proprietary material believed to be a strontium/manganese/magnesium ferrite formulation.

Typically, polymer coating coverage can be, for example, from about 30 percent to about 100 percent of the surface area of the carrier core with about a 0.1 percent to about a 4 percent coating weight. Specifically, about 75 percent to about 98 percent of the surface area is covered with the micropowder by using about a 0.3 percent to about 1.5 percent coating weight. The use of smaller-sized coating powders may be advantageous as a smaller amount by weight of the coating can be selected to sufficiently coat a carrier core. The use of smaller-sized coating powders also enables the formation of thinner coatings. Using less coating is cost effective and results in less coating amount separating from the carrier to interfere with the triboelectric charging characteristics of the toner and/or developer.

If a carrier is included, the carrier must have a resistivity of at least about $1\times10^7$ ohm-cm. As is demonstrated herein, in one embodiment the resistivity is regulated by decreasing or increasing the amount of carbon black found in the carrier. By decreasing the concentration of the carbon black in the carrier coating, the resistivity of the carrier is increased. One skilled in the art will recognize other methods of regulating the resistivity of the carrier. Other known methods for increasing resistivity of the carrier include, but are not limited to, reducing the conductivity of the carrier core particle by changing the composition or processing conditions in the formation of the core, increasing the thickness of a resistive coating polymer, increasing the resistivity of the coating polymer, changing the composition of the carbon black or other conductive additive in the carrier, or modifying the dispersion of the carbon black or other conductive additive in the carrier. Examples of conductive additives in the carrier include, but are not limited to, metal oxides, conductive polymers, such as inorganic metallic polymers disclosed in U.S. Pat. No. 6,423,460 and incorporated herein by reference, and conductive metal halides disclosed in U.S. Pat. No. 4,810,611 and incorporated herein by reference.

The charge performance of a toner and developer is frequently demarcated as q/d (mm). The toner charge (q/d) is measured as the midpoint of the toner charge distribution. The charge is reported in millimeters of displacement from the zero line in a charge spectrograph using an applied transverse electric field of 100 volts per cm. The q/d measured in mm can be converted to a value in fC/μm by multiplying the value in mm by 0.092. The preferred charge performance for both the A-zone and C-zone is between about 3 and about 15 mm displacement. A developer having toner demonstrates a charging in the A-zone of between about 3 and about 15 mm displacement. However, the developer having only toner continues to exhibit poor charge performance in the C-zone.

If the developer includes both a high resistivity toner and a high resistivity carrier, the developer exhibits charge performance in the desired range for both the A-zone and C-zone, namely, between about 3 and about 15 mm.

If a carrier is present, the toner in the developer can be from approximately 3 to approximately 15 weight percent of the developer. The remainder of the developer is the carrier.

Four ultra-low melt toners (Examples 1-4 below) were prepared as blends of latexes of an amorphous branched polyester resin and 20 wt % of a crystalline polyester resin, with a varying sulphonate content in both components. As a result of the changes to the Li sulphonate content, the conductivity of the final parent toner in A-zone (in the presence of water) increased up to 3 orders of magnitude.

These toners were then combined in developers with the two carriers, one low resistivity carrier and one high resistivity carrier. The high resistivity carrier was 4 orders of magnitude more resistive than the low resistivity carrier. This increased resistivity was accomplished by a reduction in carbon black loading in the carrier coating.

EA lithium-sulfonated polyester toners were prepared having crystalline polyester resin in the amount of 20 weight %.

Toner Preparation

The following toners were prepared:

Example 1: 1.5% Li BSPE/1.5% Li CPE (80:20) (fully described below)

Example 2: 1.5% Li BSPE/3% Li CPE (80:20)

Example 3: 3.0% Li BSPE/1.5% Li CPE (80:20)

Example 4: 3.0% Li BSPE/3.0% Li CPE (80:20)

BSPE refers to branched sulfonated amorphous polyesters resins. Similarly, CPE refers to crystalline polyester resins.

Example 1 was prepared in the following manner. In a 2 L Nalgene beaker, 531.6 grams of 18 percent by weight of the branched 1.5% lithio-sulfonated polyester resin and 237.2 grams of 10.6 percent by weight of the 1.5% lithio-sulfonated crystalline polyester resin. Both resins were emulsified by the solvent flashing method with acetone, and were then mixed together.

61.0 grams of 20.7 percent by weight of a Carnauba wax dispersion and 31.7 grams of a cyan pigment dispersion containing 26.5 percent by weight of Pigment Blue 15:3 were added to the mixture of the BPE and CPE. An additional 399.3 g of deionized water was added to the slurry to make the overall toner solids in the final slurry equal to 10.26%.

After uniform mixing, the pH of the slurry was measured to be 4.84. The pH of the slurry was not adjusted. Zinc acetate dehydrate solution (3.57 g zinc acetate dehydrate in 112.6 g deionized water equaling 1.0 weight %) was adjusted from pH 6.7 to 4.25 with 4.34 g concentrated acetic acid. The zinc acetate dehydrate solution was added at ambient temperature via a peristaltic pump over 16 minutes to the pre-toner slurry while homogenizing the slurry with an IKA Ultra Turrax T50 probe homogenizer at 3000 rpm. As the slurry began to thicken, the homogenizer rpm was increased to 4000 while shifting the beaker side-to-side. The particles diameters at which a cumulative percentage of 50% of the toner particles are attained (D50) and the average particles size distribution by volume (GSD) were measured to be 3.93 and 1.38, respectively, with the Coulter Counter Particle Size Analyzer. D50 is also known as Median diameter or Medium value of particle diameter and is the primary measurement of the size of the toner particles.

This 14 L solution was charged into a 2 liter Büchi equipped with a mechanical stirrer containing two P4 45 degree angle blades. The heating was programmed to reach 40° C. over 30 minutes with stirring at 700 revolutions per minute. After 24 minutes at 40° C., the D50 particle size of the toner had already reached 4.96 μm (only as aggregates, not as coalesced particles).

At 31 minutes into the reaction, the temperature was increased to 50° C. The D50 particle size reached 9.18 μm after 99 minutes at that temperature. The reaction was cooled overnight after a total time of 136 minutes and restarted the following day. On the following day, the pH of the slurry was increased from 4.47 to 5.19 with 23.4 grams of 1M NaOH. The temperature of the reactor was then increased to 60° C. over 30 minutes. After the 30 minutes, the temperature was further increased to 66° C. and then 70° C., so that the aggregates would properly coalesce into spherical particles.

The reaction was stopped or the heating was stopped once the particles coalesced. The total reaction time was 208 minutes. The toner slurry was quickly cooled by replacing the hot water with cold water in the circulating water bath, while stirring the slurry at 700 rpm. A sample (about 0.25 gram) of the reaction mixture was then retrieved from the Büchi, and a D50 particle size of 11.47 microns with a GSD of 1.30 was measured by the Coulter 1 counter. The product was filtered through a 25 micron stainless steel screen (#500 mesh), left in its mother liquor and settled overnight.

The following day, the mother liquor was decanted from the toner cake which settled to the bottom of the beaker. The settled toner was reslurried in 1.5 liter of deionized water, stirred for 30 minutes, and then settled again overnight. This procedure was repeated once more until the solution conductivity of the filtrate was measured to be about 11.2 microsiemens per centimeter which indicated that the washing procedure was sufficient.

The toner cake was redispersed into 300 milliliters of deionized water, and freeze-dried over 72 hours. The final dry yield of toner was estimated to be about 60% of the theoretical yield.

The toners of Examples 2-4 were prepared in an analogous manner.

Carrier Preparation

Both carriers are 35 micron ferrite core particles solution coated with a total coating weight of 2 wt % of the carrier core. The coating was a methyl(methacrylate)/perfluoroethylmethacryate copolymer incorporating carbon black in the coating. The low resistivity carrier had 18.3 weight % carbon black of the 2% coating weight. The high carbon black loading lowers the resistivity of the low resistivity carrier to $5.86\times10^{6}$ ohm-cm. The high resistivity carrier has 8.5 weight % carbon black of the total 2% coating weight. The lower carbon black loading increases the resistivity of the high resistivity carrier to $3.22\times10^{9}$ ohm-cm.

Measurement of Carrier Resistivity

Carrier samples were not conditioned prior to the measurement. The measurement was done at 21° C., 40% relative humidity (RH). To determine carrier resistivity, 30 g of carrier powder was sandwiched between two circular planar stainless steel electrodes with a diameter of 6 cm. The height of the carrier pile was adjusted to approximately 5 mm. A load of 4 kilograms was applied to the upper electrode. The circular electrodes were connected to the leads of a high-resistance meter to measure electrical resistance of the carrier pile at an applied voltage of 10 V. Carrier resistivity was calculated as resistance multiplied by the electrode surface area and divided by the pile height.

Measurement of Toner Resistivity

A 1 g sample of parent toner was conditioned overnight in the A-zone environmental chamber (28° C./85% RH). The next day the sample from A-zone was pressed with 2000 PSI pressure into pellet form using a piston and cylinder conductivity cell equipped with a hydraulic press. The resistance of the pressed toner sample was measured with a 10 V potential using a high resistance meter. The length of the pellet was measured using a digital caliper, and the resistivity of the compressed sample was calculated.

Measurement of Charging

Each toner sample was blended on a sample mill for 30 seconds at 15000 rpm, with 2.0 wt % silica, 3.4 wt % titania and 1.5 wt % X-24, a sol-gel silica. Developer samples were prepared with 0.5 g of the parent toner sample and 10 g of the carrier. A duplicate developer sample pair was prepared as above for each toner that was evaluated. One developer of the pair was conditioned overnight in A-zone (28° C./85% RH), and the other was conditioned overnight in the C-zone environmental chamber (10° C./15% RH). The next day the developer samples were sealed and agitated for 1 hour using a mixer. After 1 hour of mixing the toner tribo charge was measured using a charge spectrograph using a 100 V/cm field.

Results

The charging of a series of toners with varying resistivity from $2\times10^8$ to $4\times10^{11}$ ohm-cm on either the low resistivity carrier ($5.86\times10^6$ ohm-cm) or high resistivity carrier ($3.22\times10^9$ ohm-cm) was measured.

With the low resistivity carrier the A-zone charge performance is close to zero and shows no improvement with increased toner resistivity. With this low resistivity carrier, charge performance in the C-zone charge increased with toner resistivity.

With the high resistivity carrier, charge performance in both the A-zone charge and the C-zone increased with increasing toner resistivity, i.e., the toner resistivity was increased from $2\times10^8$ ohm-cm to $4\times10^{11}$ ohm-cm. Thus, the developer with a high resistivity carrier and a toner having a resistivity greater than $1\times10^{11}$, the charge performance in both A-zone and C-zone were within the desired range. The RH sensitivity ratio remains the same for all toners with the high resistivity carrier, and is not increased when charge performance increases.

It will be appreciated that various of the above-disclosed and other features and functions, or alternatives thereof, may be desirably combined into many other different systems or applications. Also, various presently unforeseen or Unanticipated alternatives, modifications, variations or improvements therein may be subsequently made by those skilled in the are, and are also intended to be encompassed by the following claims.

What is claimed is:

1. A developer comprising a toner and a carrier, wherein the toner comprises a sulfonated crystalline polyester resin, a sulfonated amorphous resin and a colorant, wherein the toner has a resistivity of at least about $1\times10^{11}$ ohm-cm and the carrier has a resistivity of at least about $1\times10^7$ ohm-cm.

2. The developer according to claim 1, wherein the toner is an emulsion aggregation toner.

3. The developer according to claim 1, wherein the toner is generated by physical methods.

4. The developer according to claim 1, wherein a ratio of the crystalline polyester resin to the amorphous resins from about 10:90 to about 50:50.

5. The developer according to claim 1, wherein the amorphous resin is an amorphous polyester resin, an amorphous styrene resin or an amorphous styrene/acrylate resin.

6. The developer according to claim 1, wherein the sulfonated amorphous resin is a branched amorphous resin or a linear amorphous resin.

7. The developer according to claim 1, wherein the toner in the developer is between about 3 and about 15 weight percent.

8. The developer according to claim 1, wherein the developer has a charging performance in A-zone and C-zone between about 3 and about 15 mm displacement.

9. The developer according to claim 1, wherein the carrier includes a carrier core selected from the group consisting of granular zircon, granular silicon, glass, steel, nickel, ferrites, magnetites, iron ferrites and silicon dioxide.

10. The developer according to claim 1, wherein the carrier is coated with a coating selected from the group consisting of polyvinylidene fluoride resins, terpolymers of styrene, methyl methacrylate, a silane, tetrafluorethylenes, polymethyl methacrylate, copoly-trifluoroethyl-methacrylate-methyl methacrylate, polyvinylidene fluoride, polyvinylfluoride copolybutylacrylate methacrylate, copoly perfluorooctylethylmethacrylate methylmethacrylate, polystyrene, or a copolymer of trifluoroethyl-methacrylate and methylmethacrylate containing a sodium dodecyl sulfate surfactant.

* * * * *